US006095952A

United States Patent [19]

Ali et al.

[11] Patent Number: 6,095,952

[45] Date of Patent: Aug. 1, 2000

[54] EXERCISE DEVICE

[75] Inventors: Saleem A. Ali, Glen Oaks; Franz A. Bronnimann, Ossining, both of N.Y.; Christine C. Harty, Flemington, N.J.; James J. Parslow, Averill Park; John G. Rell, Jr., Saugerties, both of N.Y.

[73] Assignee: Rensselaer Polytechnic Institute, Troy, N.Y.

[21] Appl. No.: 09/311,762

[22] Filed: May 13, 1999

[51] Int. Cl.[7] ..... A63B 22/00

[52] U.S. Cl. ..... 482/54; 482/35

[58] Field of Search ..... 482/35, 37, 51–54; 119/700; 248/925; D21/670

[56] References Cited

U.S. PATENT DOCUMENTS 5,352,166 10/1994 Chang ..... 482/37

5,549,195 8/1996 Aulagner et al. ..... 482/37

5,919,117 7/1999 Thompson et al. ..... 482/37

*Primary Examiner*—Glenn E. Richman

*Attorney, Agent, or Firm*—Carella, Byrne Bain, Gilfillan, Cecchi, Stewart & Olstein

[57] ABSTRACT

The exercise device has a horizontal section for walking/hiking purposes as well as a climbing section to simulate a mountain climbing exercise. The climbing section has an endless belt of interconnected panels, each of which is provided with a plurality of blocks to provide hand/foot holds. The blocks are movable from a retracted position to extended positions by electromagnets which are programmed to effect actuation of one or more of the blocks in a predetermined pattern. The blocks are retracted at the end of the curvilinear run of the endless belt to avoid obstruction with the continued movement of the endless belt.

33 Claims, 5 Drawing Sheets

EXERCISE DEVICE

This invention relates to an exercise device. More particularly, this invention relates to an exercise device which provides a walking/hiking/climbing surface.

Heretofore, various types of machines and devices have been known which can be used to simulate mountain climbing. For example, U.S. Pat. No. 4,923,191 describes a machine to simulate mountain climbing which employs a moving ladder-like construction formed of a plurality of rubber coated rings mounted on and between two endless movable chains.

U.S. Pat. No. 5,125,877 describes a simulated climbing wall formed of articulated panels and a suspension means for supporting the wall in such a way that the panels may move downwardly as a climber climbs the wall. When the climber reaches a certain height, a rope attached to the climber releases a brake and the panels are able to move downwardly under the weight of the climber until a second rope attached to the climber re-activates the brake to lock the panels against further movement.

U.S. Pat. No. 5,549,195 describes a climbing wall which employs articulated plates of a particular shape and construction.

Generally, the previously known climbing walls are of relatively limited use in effecting variable exercise programs.

It is an object of this invention to allow a user of an exercise device to choose from different activities such as walking, running, hiking or climbing as well as to choose a desired pace at which a respective exercise is performed.

It is another object of the invention to provide an exercise device with a climbing surface which is capable of plus and minus tilting through horizontal and vertical midpoint axes as well as curved diagonal axes.

It is another object of the invention to monitor the climbing position of a user during operation of the exercise device.

It is another object of the invention to control the rate of descent of the climbing surface of the exercise device when in use.

Briefly, the invention provides an exercise device having a walking/hiking section formed by a motor driven horizontally disposed endless belt and a climbing section formed by a second endless belt having a lower run, a vertical run and a curvilinear run extending from an upper part of the vertical run to a forward part of the lower run. In addition, a plurality of blocks are provided in the climbing belt with each block being movably mounted for movement between a retracted position within the belt and an extended position projecting from the belt. Means are also provided for selectively actuating the blocks to move into the extended positions along the curvilinear run of the belt in order to define one of a hand hold and foot hold for climbing of a user thereon.

The exercise device is constructed so that a user may simply use the walking/hiking section to conduct a walking exercise or a hiking exercise without using the climbing section. In this respect, the horizontally disposed belt of the walking/hiking section is mounted in a frame which includes means for tilting the frame relative to a support surface about both a longitudinal axis and a transverse of the frame. The tilting may occur about both axes and may occur in a programmed manner during use so as to provide the effect of an uneven walking surface for the user.

The exercise device may also be used to provide only a climbing exercise for the user. In this mode of operation, the user would simply walk up to the climbing belt and grasp the projecting blocks and step on the projecting blocks to begin climbing. As the user climbs vertically upwardly along the curvilinear run of the belt, and reaches a certain level, the climbing belt is moved in a downward direction. This downward movement may be affected simply by the weight of the user or the belt may be programmed to move downwardly at a given speed.

The climbing belt is also coupled with a braking system for slowing travel of the climbing belt under the weight of the user.

These and other objects and advantages of the invention will become more apparent from the following detailed description taken in conjunction with the accompanying drawings wherein.

Figure 13:
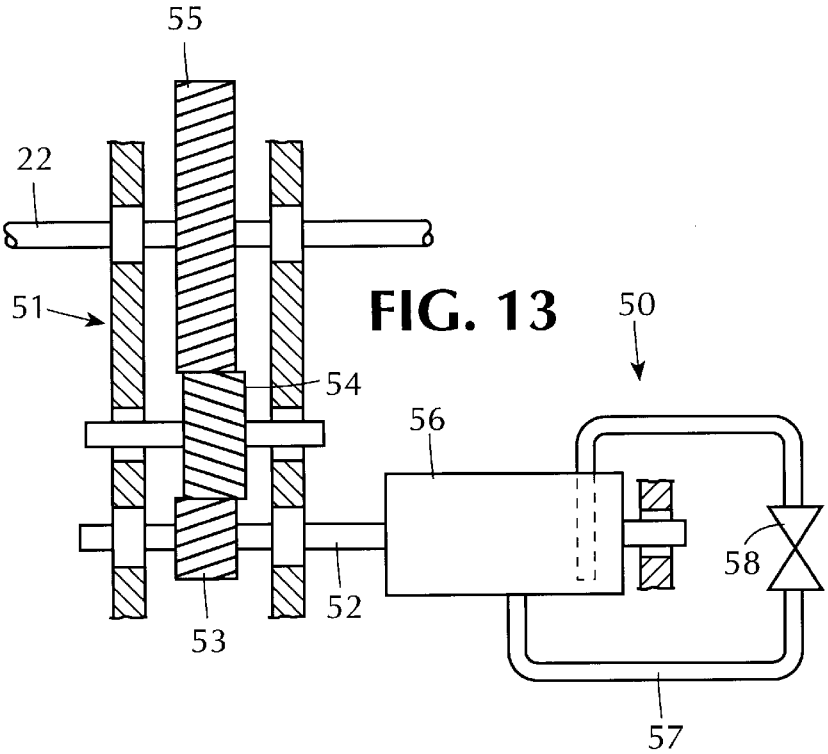
Figure 14:
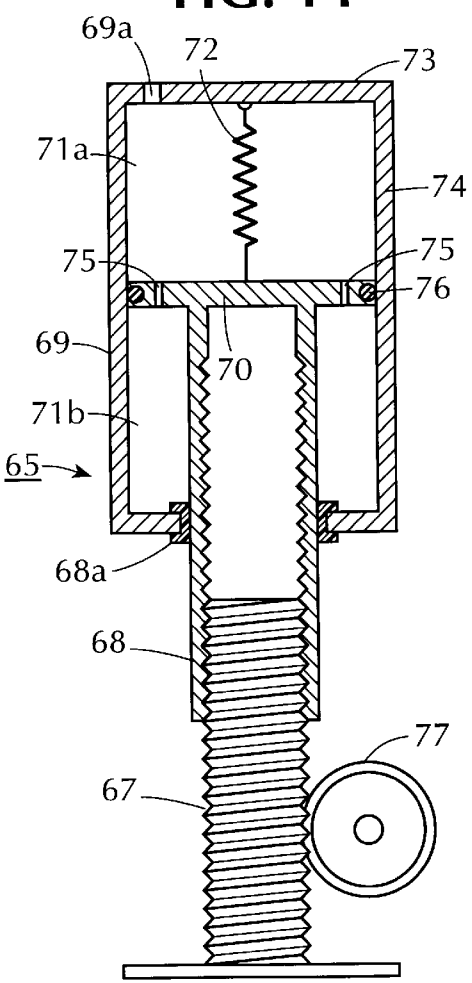
Figure 15:
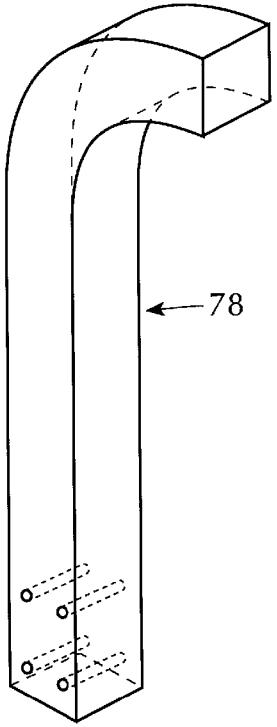

FIG. 13 schematically illustrates a braking system for the climbing belt in accordance with the invention;

FIG. 14 illustrates a part-cross sectional view of a tilt unit for the sections of the exercise device; and FIG. 15 illustrates a perspective view of a support for receiving a safety harness to be used by a user of the device.

Figure 1:
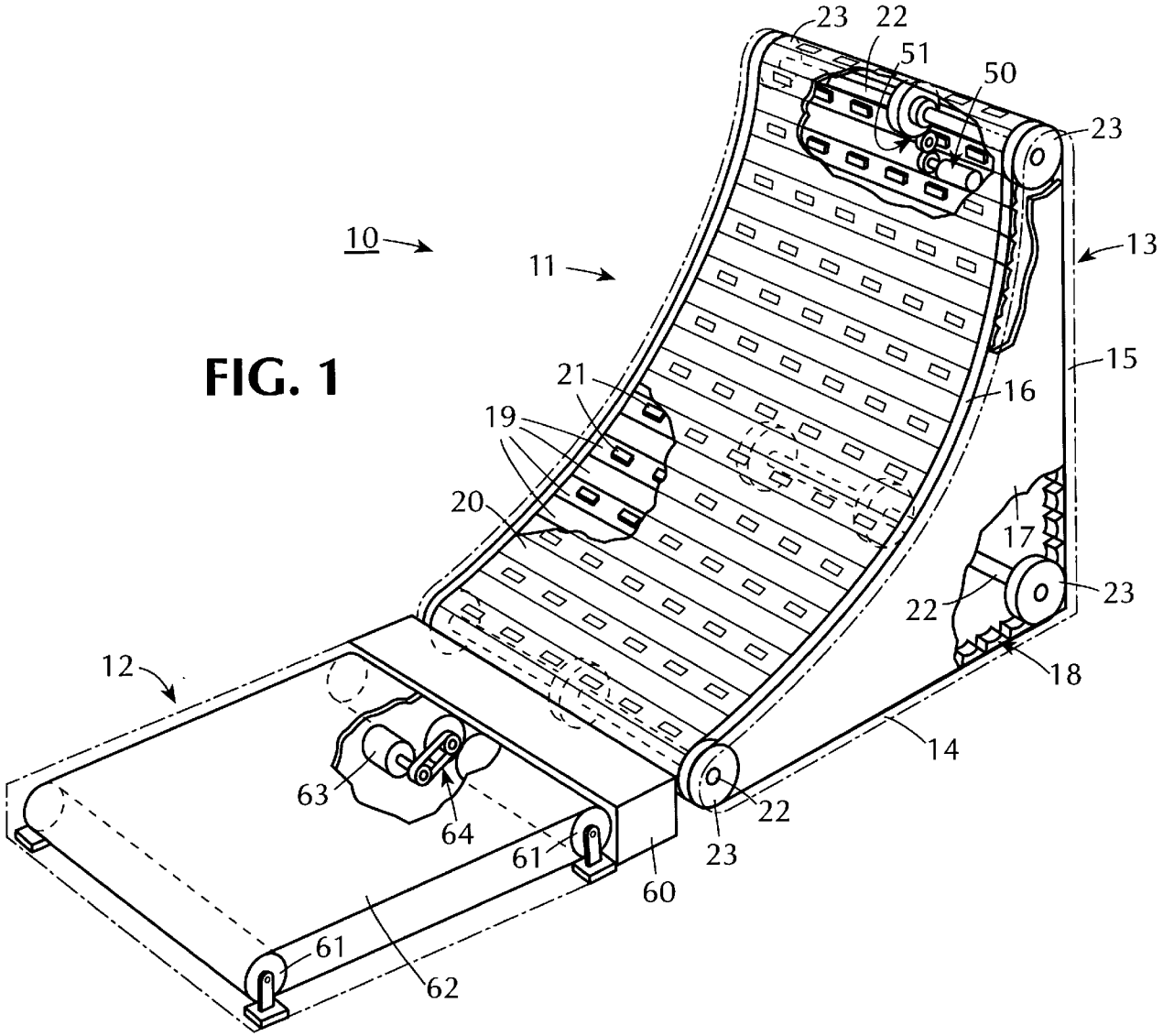
FIG. 1 illustrates a perspective view of an exercise device constructed in accordance with the invention.

Referring to FIG. 1, the exercise device 10 includes a climbing section 11 and a walking/hiking section 12. The climbing section 11 is used to simulate wall climbing or mountain climbing exercises while the walking/hiking section 12 is used for a walking or hiking exercise.

The climbing section 11 includes an upstanding frame 13 of skeletal construction which defines a horizontal base 14, an upstanding rear 15 and a curvilinear front 16 extending from an upper part of the rear 15 to a forward part of the base 14. Suitable side plates 17 (only one of which is shown) are mounted on the sides and rear of the frame 13 to provide an enclosed space.

The climbing section 11 also includes an endless climbing belt 18 which is disposed transversely across the frame 13 with a lower run extending along the base 14, a vertical run extending along the rear 15 and a curvilinear run extending along the curvilinear front 16 of the frame 13. The climbing belt 18 is formed of a plurality of horizontally and vertically interconnected panels 19 which are disposed transversely of the frame 13 and which ride in suitable guide slots (not shown) in the frame 13.

A textured endless sheet 20 is disposed over the climbing belt 18 to provide a climbing surface. This sheet 20 serves to seal off the openings in the climbing belt 18 and provides traction due to the textured surface.

The sheet 20 is connected to the climbing belt 18 with a suitable adhesive that bonds the belt 18 and sheet 20 together to form a two-layer laminate. Typically, the textured sheet 20 is a vulcanized sheet of rubber that is used for safety reasons, namely to keep the hinged panels 19 of the climbing belt 18 away from the user. The textured sheet 20 may also be tailored in such a way as to provide different aesthetic designs.

Each panel 19 of the climbing belt 18 has a plurality of horizontally spaced apart openings while the textured sheet 20 has a plurality of apertures aligned with the openings in the panels 19. In addition, a plurality of blocks 21 are provided in the climbing belt 18 to provide a hand hold and/or a foot hold. Each block 21 is movably mounted in a respective opening of a panel 19 for movement between a retracted position within the panel 19 and an extended position projecting from the panel 19 through a respective aperture in the textured sheet 20.

As illustrated, the climbing section 11 has a plurality of rotatable shafts 22 on which guide wheels 23 are provided for guiding the climbing belt 18 and sheet 20 during movement thereof. Each guide roller 23 is constructed as a gear and each panel 19 of the climbing belt 18 is provided with a toothed inner surface 24 (see FIG. 4) for meshing with the rollers 23. The upper shaft 22 functions as a drive axle while the other shafts 22 function as supporting axles.

Figure 3:
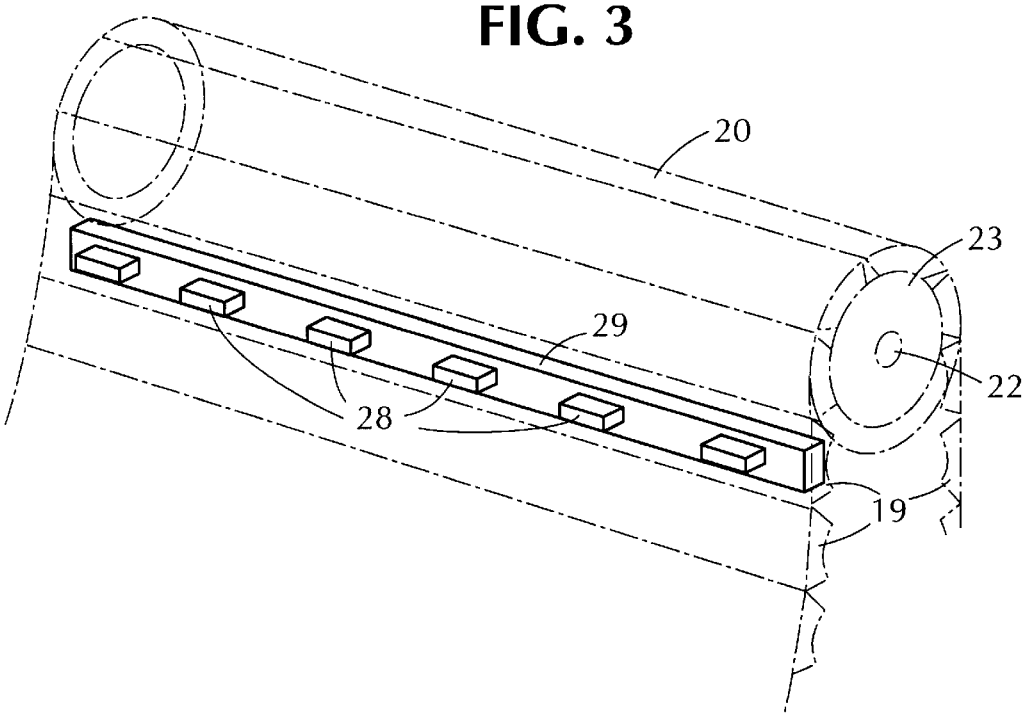
FIG. 3 illustrates an electromagnet actuator array for actuating selected blocks in vertical rows of the exercise device.
Figure 2:
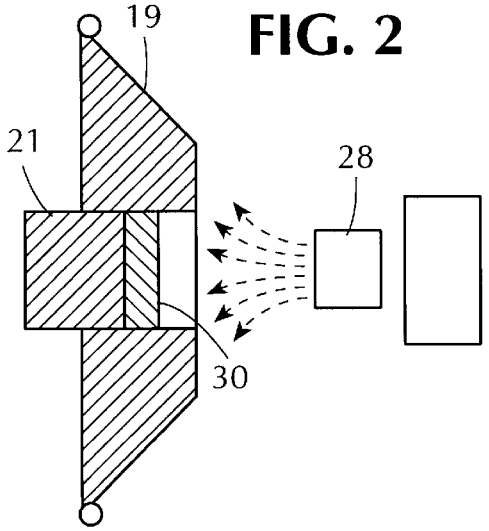
FIG. 2 illustrates an electromagnetic means for selectively actuating a block in accordance with the invention.

Referring to FIGS. 2 and 3, a means is provided for selectively actuating the blocks 21 to move into the extended positions along the curvilinear front 16 of the frame in order to define a hand/foot hold for climbing purposes. This means includes an electromagnet actuator array 27 which is mounted at the upper end of the curvilinear front 16 of the frame 13. This array 27 includes a plurality of electromagnets 28 spaced longitudinally across a member 29 secured to the frame 13 in a fixed manner. Each electromagnet 28 is aligned with a vertical row of blocks 21 on the climbing belt 18 as well as with a guide rail (not shown) secured within the frame 13 to guide the climbing belt 18 downwardly along the curvilinear front 16 of the climbing section.

As illustrated in FIG. 2, each block 21 on a panel 19 of the climbing belt 13 carries a ferromagnetic plate 30 on the back side to face an electromagnet 28 when the panel 19 moves past the actuator array 27. The electromagnet 28 is energized from time to time in a programmed manner so as to create a magnetic field to selectively repulse the plate 30 therefrom and thereby effect movement of the block 21 secured thereto to an extended position from the panel 19 as illustrated in FIG. 2 as well as through the textured sheet 20.

Programming of the electromagnets 28 may be done in a suitable manner. For example, a software program may be incorporated in a central processing unit CPU (not shown) of the exercise device 10 which can be programmed from time to time by the user to select a pattern of blocks 21 to be extended from the respective panels 19 of the climbing belt 18.

In general, the central processing unit (CPU) uses input specified by the user such as weight, height, difficulty level, a choice of topographies and the like to mimic a landscape in such a manner to provide an enjoyable workout beneficial to the needs of the user. Feedback is supplied to the CPU via sensors located on each block 21.

Figure 4:
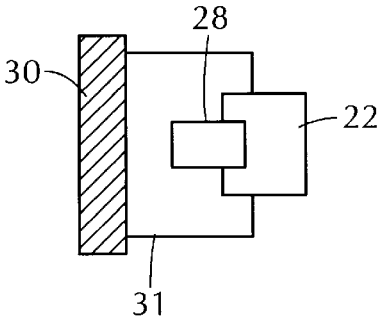
FIG. 4 illustrates a top view of one ferromagnetic plate of a block in relation to an electromagnet of the actuator array of FIG. 3.

Referring to FIG. 4, each ferromagnetic plate 30 has a pair of sensory prongs 31 which project into sliding engagement with an internal ohmmeter 32 which is attached to an electromagnet 28 of the actuator array 27 shown in FIG. 3 and which directs information to the CPU. Each plate 30 emits a unique resistive signal which identifies that plate 30 and the block 21 secured thereto. Thus, when the prongs 31 complete a circuit with the ohmmeter 32, the CPU can detect the unique resistance value of the plate 30.

Thus, the prongs 31 provide an isolated electronic circuit pathway which effectively enables the electromagnets 28 to identify the blocks 21. In this manner, each electromagnet 28 can discern a target block 21 from all others and avoid false actuation.

If actuation of specific electromagnets 28 is required, as determined by the programming of the system, the CPU sends signals to the actuator array 27 in order to activate only those target electromagnets 28 that have been identified as described above. This, in turn, causes the selected electromagnets 28 to repulse the blocks 21 (see FIG. 2) that correspond to the selected target electromagnets 28.

It is to be noted that each target block 21 is discerned from the others by utilizing the CPU. In this respect, the CPU is programmed to discern between each of the blocks 21 by analyzing the unique resistive signal captured by the prongs 31.

Figure 7:
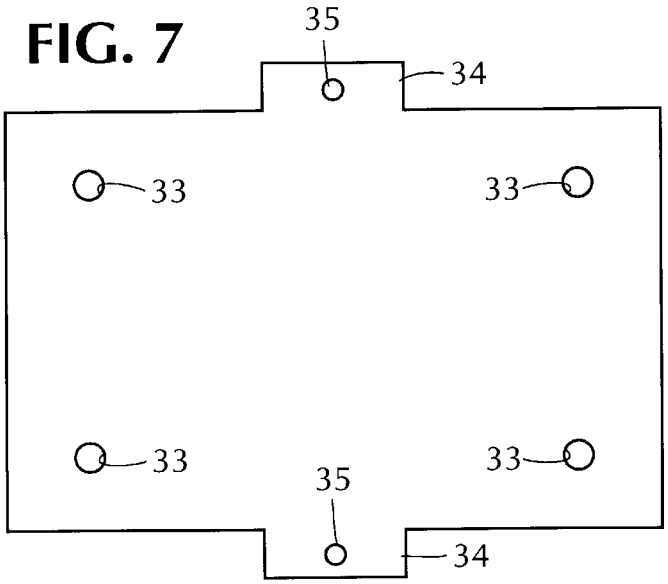
FIG. 7 illustrates a ferromagnetic plate employed in the mounting of a block in the climbing belt.
Figure 8:
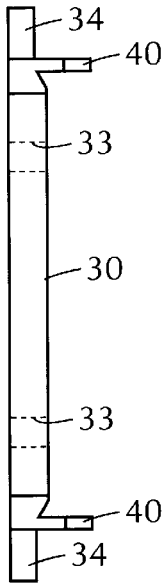
FIG. 8 illustrates a side view of the ferromagnetic plate of FIG. 7.
Figure 9:
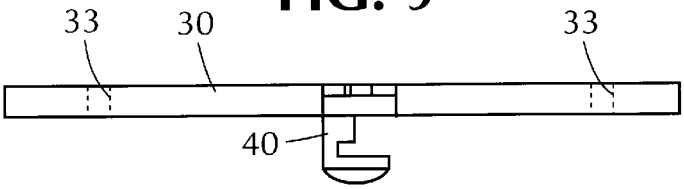
FIG. 9 illustrates an end view of the plate of FIG. 7.

Referring to FIGS. 7, 8 and 9, each ferromagnetic plate 30 is provided with four mounting holes 33 for suitable bolts (not shown) by means of which the plate 30 is connected to a block 21 (not shown). Each plate 30 also has a pair of ears 34 on opposite sides with each ear 34 having an aperture 35.

Figure 5:
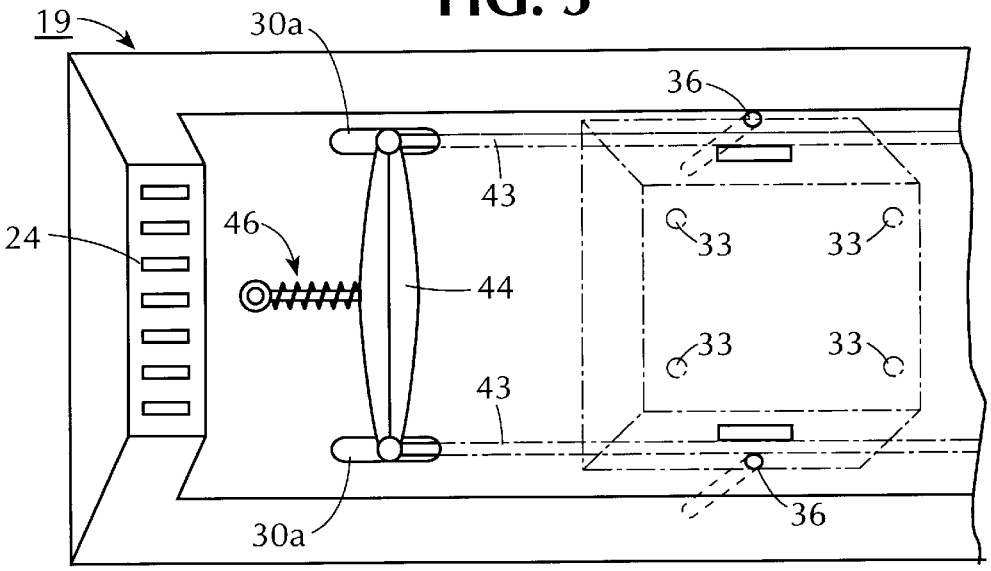
FIG. 5 illustrates a back view of a section of the climbing belt.
Figure 12:
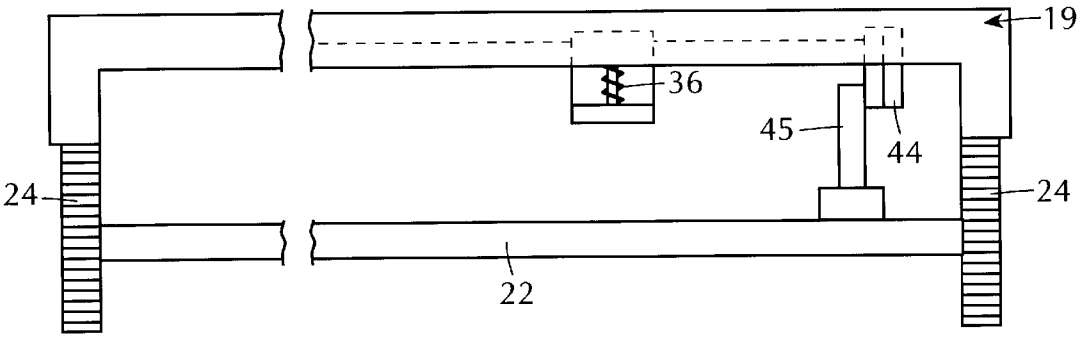
FIG. 12 illustrates a front view of the unlocking mechanism for a block.

Referring to FIGS. 5 and 12, each block 21 with a ferromagnetic plate 30 thereon is mounted within a panel 19 in a spring-biased manner by a pair of spring mechanisms 36 which bias the block 19 from the extended position shown in FIG. 2 to a retracted position within the panel 19. One spring mechanism 36 is schematically shown in FIG. 12.

Figure 6:
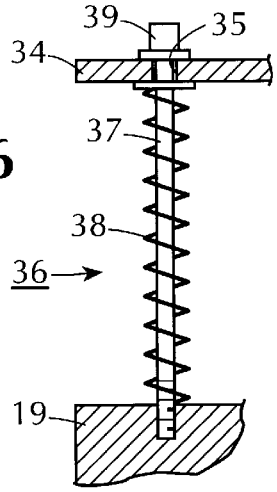
FIG. 6 illustrates a spring mechanism employed in mounting a block in the climbing belt.

Referring to FIG. 6, each spring mechanism 36 includes a pin 37 which is secured in a panel 19 and passes through an aperture 35 in a respective ear 34 of the ferromagnet plate 30, a coil spring 38 disposed coaxially of the pin 37 between the panel 19 and the ferromagnetic plate 30 for biasing the plate 30 away from the panel 19, and a suitable cap 39 mounted on the end of the pin 37 in order to maintain the ferromagnetic plate 30 and block 21 on the panel 19.

Referring to FIG. 2, after an electromagnet 28 has effected movement of a block 21 to an extended position, there is a need to lock the block 21 in this position. To this end, a releasable locking means is provided on each panel 19 for locking the blocks 21 in the extended positions. Referring to FIGS. 8 and 9, each locking means includes a pair of latches 40 which are mounted in depending relation on each plate 30 and a pair of receptors 41 (see FIG. 10) which are mounted on the panel 19 for selectively receiving the latches 40 in locking relation. As indicated in FIG. 9, each latch 40 is of generally L-shape construction and extends perpendicularly from the plate 30. Each receptor 41, as shown in FIG. 10, includes a slot 42 into which the respective latch 40 may pass.

Figure 10:
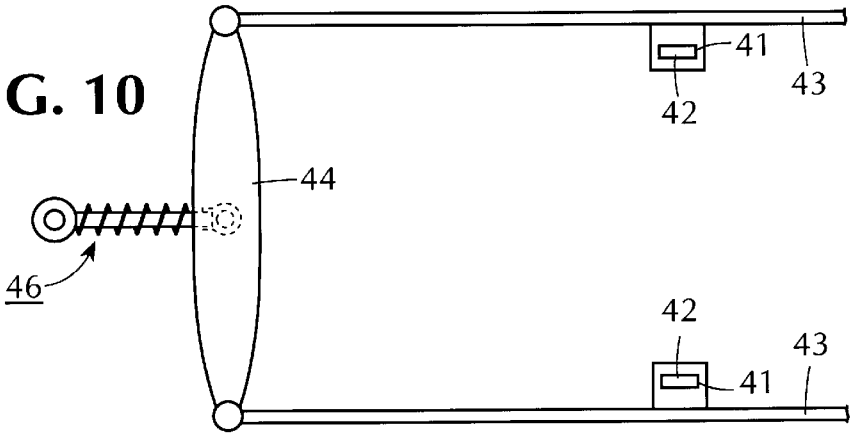
FIG. 10 illustrates the components of a locking mechanism for releasing a block from an extended position in the climbing belt.
Figure 11:
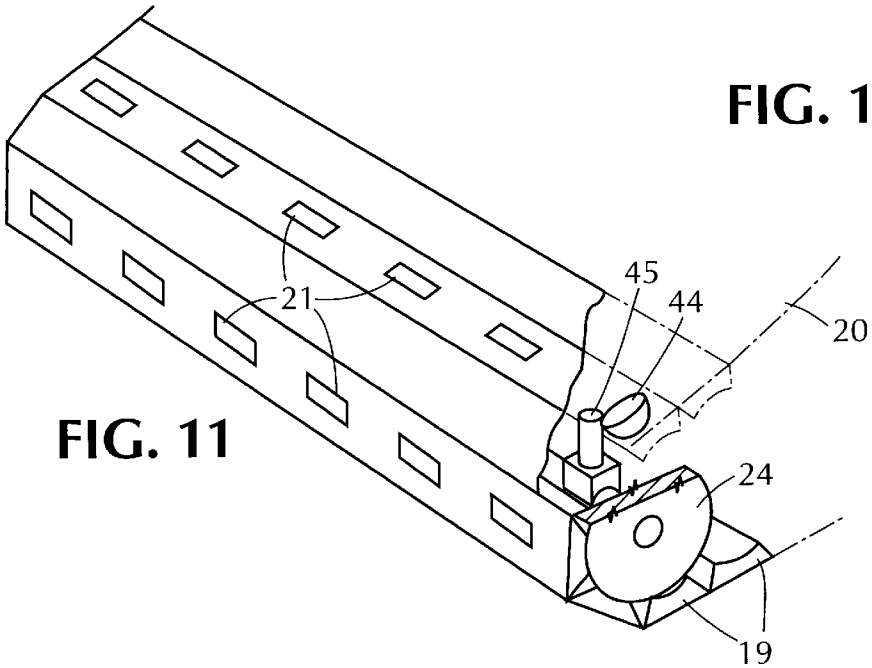
FIG. 11 illustrates a part-perspective view of the climbing belt and the unlocking mechanism.

As also shown in FIG. 10, the locking means also employs a pair of parallel rods 43 which are secured in common to each pair of receptors 41 and are disposed along the length of a panel 19. These rods 43 are suitably guided on guide rails (not shown) on the inner surface of the panel 19. In addition, a cam follower 44 is articulated to the rods 43 at one end to cooperate with a cam 45 (see FIGS. 11 and 12) mounted on the frame 13 adjacent a lower part of the curvilinear front of the frame 13 in the path of movement of the cam follower 44. The cam follower 44 is in the shape of an ellipsoid or wedge so that upon movement against the cam 45, the cam follower 44 is moved outwardly of the panel 19 thereby causing the rods 43 to move longitudinally of the panel in a direction to release the latches 40 from engagement with the receptors 41. At this time, the springs 38 of the spring mechanism (see FIG. 6) bias the plate 30 and the block 21 thereon back to the retracted position within the panel 19.

Referring to FIGS. 5 and 10, the wedge 44 is mounted on a spring mechanism 46 so as to be biased in a direction towards the cam 45 (see FIG. 12), that is to say, into a locking position. The spring mechanism 46 acts to resist the motion of the cam follower 44 away from the cam 45 and acts to keep the receptors 41 in a locking position. When a pair of latches 40 are moving into the receptors 41 (FIG. 10), the spring mechanism 46 allows the receptors 41 and rods 43 to move in a direction (to the right in FIG. 10) to accept the latches 40. Also, the spring mechanism 46 will move to return to its unbiased position when the cam 45 acts against the cam follower 44 to unlock the latches 40 from the receptors 41 within that horizontal row.

Referring to FIG. 1, the climbing section 11 of the exercise device 10 is provided with a braking system 50 for slowing travel of the climbing belt 18 under the weight of a user. As illustrated, the braking system 50 is connected via a transmission 51 to the drive shaft 22 at the upper part of the climbing section 11.

Referring to FIG. 13, the braking system 50 includes a rotatable stub shaft 52 which is rotatably mounted in the frame 13 and which carries a gear 53 of the transmission 51. The gear 53, in turn, is in meshing engagement with an intermediate gear 54 which meshes with a gear 55 of the transmission 51 on the drive shaft 22. In addition, a pump 56 receives the stub shaft 52 and a closed loop 57 for circulating fluid through the pump 56 is connected with the pump 56. As indicated, the closed loop 57 has an inlet communicating with a bottom of the pump 56 and an outlet communicating with an upper part of the interior of the pump 56. In addition, a variable valve 58 is disposed in the loop 57 to control the flow of fluid therethrough and a sensor (not shown) is provided to sense a pressure change in the loop 57 and to actuate the valve 58 to compensate for changes in pressure.

In operation, the closed loop 57 constitutes a closed fluid system which is under a predetermined steady state pressure. The weight of a user on the climbing section 11 of the exercise 10 acts as a force which increases the fluid pressure in the closed loop 57. That is to say, the weight of the user tends to increase the downward speed of the climbing section 11 so that the transmission 51 transmits a force via the stub shaft 52 into the pump 56 to thereby increase the pressure in the lower part of the closed loop 57.

During use, the stub shaft 52 turns the pump 56. The ensuing pumping action causes a pressure increase and the valve 58 regulates this pressure in order to control the motion of the climbing belt 18. In effect, an attempt to turn the shaft 52 with the valve 58 closed would result in nearly zero motion in the belt 18.

The pressure sensor (not shown) accordingly senses an increase in pressure and delivers a corresponding signal to the central processing unit (not shown) of the machine 10. The central processing unit, in turn, determines the proper rate of descent of the user and delivers a corresponding signal to the valve 28 to open (or close) to compensate for the change in pressure and thereby achieve the desired rate of decent. Referring to FIG. 1, the horizontally disposed walking/hiking section 12 is constructed in a manner of a conventional treadmill. To this end, the walking/hiking section 12 has a horizontally disposed frame 60, a pair of rotatably mounted rollers 61 and an endless belt 62 which passes about the rollers 61. In addition, a motor 63 is The walking/hiking section 12 is further provided with means for tilting the frame 61. To this end, the means for tilting includes a plurality of lift units 65 (one of which is shown in FIG. 14), each of which is disposed adjacent a-corner of the frame 60 (not shown). Referring to FIG. 14, each lift unit 65 is constructed, in part, as a lifting/lowering device and, in part, as a shock absorber. To this end, each lift unit 65 includes a base 66 which rests on a suitable support surface, such as a floor, an externally threaded rotatable shaft 67 which is rotatably mounted on the base 66 in an upright manner and an internally threaded sleeve 68 which threadably receives the shaft 67.

The sleeve 68, in turn, moves freely up and down within a fluid filled cylinder 69. An annular seal 68 a is provided on the cylinder 69 to seal against the sleeve 68 to prevent leakage of fluid from the cylinder 69 between the sleeve 68 and cylinder 69. A plate 70 is secured to and across the sleeve 68 within the cylinder 69 to sub-divide the interior of the cylinder 69 into two chambers 71*a*, 71*b*. In addition, a spring 72 is fixed between the plate 70 and an upper wall 73 of the cylinder 69 in order to bias the plate 70 in an upward direction. The chamber 71*a* defined by the plate 70 and upper wall 73 is filled with a suitable fluid 74 and a pair of fluid junction openings 75 are provided in the plate 70 to communicate the two chambers 71*a*, 71*b* with each other. An O-ring seal 76 is also disposed on the plate 70 to seal against the cylinder 69. The cylinder 69 also has a port 69*a* for filling the cylinder 69 with fluid.

During use, the only limiting factor on the movement of the sleeve 68 within the fluid filled cylinder 69 is from the spring 72 and the fluid openings 75 which act to dampen any spring oscillations. In general, each lifting unit 65 is constructed to absorb and dissipate energy from the use of the machine 10. Such energy is harnessed by the spring 72 and then dissipated by the fluid holes 75.

A drive motor in the form of a worm drive gear 77 is also provided for rotating the shaft 67 within the sleeve 68 in order to raise or lower the respective comer of the frame 13 relative to the support surface.

The frame of the walking/hiking section 12 may be tilted about a longitudinal central axis and/or a horizontal central axis. That is to say, the lift units 65 may be actuated so as to lift or lower a corner of the frame 60 relative to the other corners to provide a tilted and/or skewed surface on which to walk or hike. Further, the motors 77 of the lift units 65 may be programmed to provide a continuous adjustment in the degree of tilt and/or skew.

Referring to FIG. 15, a rigid belt support 78 is provided for securement to the back of the climbing section 11 in order to receive a safety harness to be worn by a user. The harness operates in a similar fashion to that of a conventional seat belt and is held in place by the support 78. In this respect, the safety harness extends from within the support 78 and the control mechanism directing the operation of the safety harness is housed within the support 78. The safety harness functions in a manner such that when the user ascends the climbing section, the belt is automatically retracted or reeled into the support 78 keeping the slack between the position of the user and that of the connection point of the belt, approximately the same. The harness is free to move in both directions but is locked in place when a sufficiently rapid acceleration is detected.

The safety harness may also serve a second function as a position sensor. To this end, a secondary electromechanical sensor system (not shown) is interfaced with a unidirectional mechanical reel of the safety belt. Essentially, the displacement of the safety belt within the mechanical retractor (support 78) corresponds to a specific current level which, in turn, defines a particular height on the climbing surface. The mechanism is similar to a wind-up potentiometer. The more retracted belt there is, the smaller the current, and consequently the higher the position of the user on the climbing section.

During operation, the motion of the belt 18 on the climbing section 11 is controlled by the braking system 50. In the initial state, the climbing belt 18 is stationary. When a user begins climbing up the belt 18 via the blocks 21 and gains a certain maximum height, an electronic sensing subsystem (not shown) causes the climbing belt 18 to begin to move down to a specified minimum height thereby restarting the process. Thus, the user climbs up to a certain height and then the belt moves downwardly, as distinct from the belt moving continuously. As the climbing belt 18 circulates, selected blocks 21 are moved to the extended positions and locked in place at the upper end of the belt 18. Upon reaching the lower end of this run, the cam 45 releases each of the extended blocks 21 via the unlatching cam follower 44, rods 43 and receptors 42. At this time, the spring mechanism of each extended block 21 biases the blocks 21 back to the retracted positions. The climbing belt 18 is thus free to travel along the lower run without the blocks 21 obstructing this motion.

The blocks 21 may be fabricated from vulcanized rubber to simulate the appearance of rocky surfaces. Further, the blocks 21 are retracted or extended via by a suitable electronic control system (not shown) through the electromagnetics 28 to provide varying levels of climbing difficulty. By varying the mode of actuation within various regions of the climbing belt, one may effectively alter the topology of the climbing surface.

The climbing surface can be viewed as a combination exponential function, (i.e. $y \approx 2^x$). As a result, distinct angles of climbing are located at different positions of the climbing surface 11. The control system monitors the position of the user and keeps the user in a well defined climbing position so as to facilitate climbing at a particular angle. The control system may therefore vary the position of the user through the implementation of different degrees of braking resistance.

The exercise device 10 is made of any suitable size and particularly of a size to be moved from place to place in a fitness center or the like. For example, the total length of the device 10 may be ten (10) feet with a walking section 12 of five (5) feet in length. The height of the climbing section 11 may be ten (10) feet. The over width of the belt 18 may be five and one-half feet with an overall width of the exercise device 10 being six feet.

The exercise device 10 may also be provided with an array of sensors to provide the user with an instantaneous readout of the current tilt of the climbing surface in conjunction with low intensity lighting tracks placed along the length of the surface to provide course direction to the user depending on difficulty level. Other readouts may include the user's rate of climbing, the distance covered, total ascent and the work done, for example as a function of calories burned.

The invention thus provides an exercise device which provides a walking/hiking and climbing surface for a user. The device is of a dynamic construction and the topology of the climbing surface can be selectively varied during use.

What is claimed is:

1. An exercise device comprising a frame defining a horizontal base, an upstanding rear and a curvilinear front extending from an upper part of said rear to a forward part of said base;

an endless belt disposed transversely across said frame with a lower run extending along said base, a vertical run extending along said rear and a curvilinear run extending along said curvilinear front, said belt including a plurality of interconnected panels disposed transversely of said frame, each said panel having a plurality of horizontally spaced apart openings therein;

a textured endless sheet disposed over said belt to provide a climbing surface, said sheet having a plurality of apertures therein, each aperture being aligned with a respective opening in said panels;

a plurality of blocks, each said block being movably mounted in a respective opening in said panels for movement between a retracted position within a respective panel and an extended position projecting from said respective panel and through a respective aperture in said sheet; and means for selectively actuating said blocks to move into said extended positions along said curvilinear front of said frame to define one of a hand hold and a foot hold for climbing thereon.

2. An exercise device as set forth in claim 1 which further comprises a spring mechanism biasing a respective one of said blocks from said extended position thereof to said retracted position thereof.

3. An exercise device as set forth in claim 2 wherein each block has a ferromagnetic plate thereon and said means for selectively actuating said blocks includes a plurality of transversely spaced electromagnets mounted at an upper part of said curvilinear front of said frame, each electromagnet being aligned with a vertical row of said blocks to selectively repulse said plates thereon to effect movement of said blocks thereon to said extended positions.

4. An exercise device as set forth in claim 3 wherein said spring mechanism includes a pair of pins secured to a respective panel in parallel and passing through a respective ferromagnetic plate; a pair of coil springs, each spring being disposed coaxially of a respective pin between said respective panel and said respective plate; and a pair of caps, each cap being mounted on a respective pin to maintain said respective plate thereon.

5. An exercise device as set forth in claim 3 which further comprises a plurality of releasable locking means on each said panel for locking said blocks in said extended positions thereof.

6. An exercise device as set forth in claim 5 wherein each locking means includes a pair of latches mounted on each respective ferromagnetic plate and a pair of receptors mounted on a respective panel for selectively receiving said latches in locking relation.

7. An exercise device as set forth in claim 6 which further comprises a pair of parallel rods connected to each pair of said pair of latches on each respective panel, a cam follower articulated to said parallel rods at one end thereof, a cam mounted on said frame adjacent a lower part of said curvilinear front in a path of movement of said cam follower for moving said cam follower and said rods connected thereto relative to said blocks in said respective panels to release said latches of each locking means from said receptors thereof.

8. An exercise device as set forth in claim 7 which further comprises a spring biasing each cam follower towards said cam.

9. An exercise device as set forth in claim 3 wherein said frame includes a plurality of guide rails extending along said curvilinear front and each block is a resistive component and which further comprises a pair of prongs projecting from each block into sliding engagement with a respective guide rail.

10. An exercise device as set forth in claim 1 which further comprises a plurality of shafts rotatably mounted in said frame and a pair of gears mounted on each shaft, and wherein each panel has a toothed segment at each end for meshing engagement with a respective gear.

11. An exercise device as set forth in claim 10 which further comprises a motor for driving at least one of said shafts to effect movement of said endless belt along said curvilinear run in a direction from said upper part of said rear towards said forward part of said base.

12. An exercise device as set forth in claim 11 which further comprises a braking system for slowing travel of said endless belt under the weight of a user.

13. An exercise device as set forth in claim 12 wherein said braking system includes a rotatable stub shaft, a gear mounted on said shaft in meshing engagement with a gear on one of said shafts on said frame, a housing receiving said stub shaft, a closed loop having an inlet communicating with said housing and an outlet communicating with said housing to circulate fluid therethrough and a variable valve in said loop to control a flow of fluid therein.

14. An exercise device as set forth in claim 1 further comprising a horizontally disposed second frame extending from said base and having an endless belt therein to defining a walking surface and a motor for driving said endless belt thereof.

15. An exercise device as set forth in claim 14 which further comprises means for tilting said second frame.

16. An exercise device as set forth in claim 15 wherein said means for tilting said second frame includes a plurality of lift units, each lift unit being disposed adjacent a comer of said second frame and including a sleeve fixed to said second frame, a rotatable shaft threaded into and extending from said sleeve to a support surface and a drive motor for rotating said shaft within said sleeve to raise or lower said respective corner of said second frame relative to the support surface.

17. An exercise device as set forth in claim 16 which further comprises a fluid shock absorber within each lift unit.

18. In an exercise device, the combination comprising an endless belt having a lower run, a vertical run and a curvilinear run extending from an upper part of said run to a forward part of said lower run;

a plurality of blocks, each block being movably mounted in said belt for movement between a retracted position within said belt and an extended position projecting from said belt; and means for selectively actuating said blocks to move into said extended positions along said curvilinear run to define one of a hand hold and a foot hold for climbing of a user thereon.

19. The combination as set forth in claim 18 which further comprises a spring mechanism biasing a respective one of said blocks from said extended position thereof to said retracted position thereof.

20. The combination as set forth in claim 18 which further comprises a plurality of releasable locking means on said belt for locking said blocks in said extended positions thereof.

21. The combination as set forth in claim 18 which further comprises a braking system for slowing travel of said endless belt under the weight of a user.

22. The combination as set forth in claim 18 further comprising a horizontally disposed second frame extending from said base and having an endless belt therein to defining a walking surface and a motor for driving said endless belt thereof.

23. An exercise device comprising a walking section having a first horizontally disposed endless belt; and means for driving said belt to provide for one of a walking and hiking exercise for a user therein; and a climbing section having a second endless belt having a lower run, a vertical run and a curvilinear run extending from an upper part of said run vertical to a forward part of said lower run; a plurality of blocks, each block being movably mounted in said second belt for movement between a retracted position within said second belt and an extended position projecting from said second belt; and means for selectively actuating said blocks to move into said extended positions along said curvilinear run to define one of a hand hold and a foot hold for climbing of a user thereon.

24. In an exercise device, the combination comprising a climbing section including an upstanding frame having an endless belt mounted therein;

a plurality of blocks, each block being movably mounted in said belt for movement between a retracted position within said belt and an extended position projecting from said belt; and means for selectively actuating said blocks to move into said extended positions to define one of a hand hold and a foot hold for climbing of a user thereon.

25. The combination as set forth in claim 24 which further comprises a spring mechanism biasing a respective one of said blocks from said extended position thereof to said retracted position thereof.

26. The combination as set forth in claim 24 which further comprises a plurality of releasable locking means on said belt for locking said blocks in said extended positions thereof.

27. The combination as set forth in claim 24 which further comprises a braking system for slowing travel of said endless belt under the weight of a user.

28. An exercise device comprising a frame defining a horizontal base, an upstanding rear and a curvilinear front extending from an upper part of said rear to a forward part of said base;

an endless belt disposed transversely across said frame with a lower run extending along said base, a vertical run extending along said rear and a curvilinear run extending along said curvilinear front, said belt including a plurality of interconnected panels disposed transversely of said frame, each said panel having a plurality of horizontally spaced apart openings therein;

a textured endless sheet disposed over said belt to provide a climbing surface, said sheet having a plurality of apertures therein, each aperture being aligned with a respective opening in said panels; and a plurality of blocks, each said block being mounted in a respective opening in said panels and projecting from said respective panel and through a respective aperture in said sheet.

29. An exercise device as set forth in claim 28 which further comprises a braking system for slowing travel of said endless belt under the weight of a user.

30. An exercise device as set forth in claim 29 wherein said braking system includes a rotatable stub shaft, a gear mounted on said shaft in meshing engagement with a gear on one of said shafts on said frame, a housing receiving said stub shaft, a closed loop having an inlet communicating with said housing and an outlet communicating with said housing to circulate fluid therethrough and a variable valve in said loop to control a flow of fluid therein.

31. An exercise device as set forth in claim 28 further comprising a horizontally disposed second frame extending from said base and having an endless belt therein to defining a walking surface and a motor for driving said endless belt thereof.

32. An exercise device as set forth in claim 31 which further comprises means for tilting said second frame.

33. An exercise device as set forth in claim 32 wherein said means for tilting said second frame includes a plurality of lift units, each lift unit being disposed adjacent a corner of said second frame and including a sleeve fixed to said second frame, a rotatable shaft threaded into and extending from said sleeve to a support surface and a drive motor for rotating said shaft within said sleeve to raise or lower said respective corner of said second frame relative to the support surface.

* * * * *